United States Patent [19]

Luckenbach

[11] 4,168,872

[45] Sep. 25, 1979

[54] ROTABLE SHAFT HAVING ELECTRICAL CONNECTION THERETHROUGH

[75] Inventor: David P. Luckenbach, West Haven, Conn.

[73] Assignee: McGraw-Edison Company, Elgin, Ill.

[21] Appl. No.: 926,740

[22] Filed: Jul. 21, 1978

[51] Int. Cl.[2] ..... H01R 39/00
[52] U.S. Cl. ..... 339/5 S; 339/9 RY
[58] Field of Search ..... 339/5 S, 5 R, 8 R, 9 RY

[56] References Cited

U.S. PATENT DOCUMENTS

| | | | |
|---|---|---|---|
| 2,284,384 | 5/1942 | Evans | 339/5 R |
| 2,537,714 | 1/1951 | Spielman | 339/5 R |

FOREIGN PATENT DOCUMENTS

| | | | |
|---|---|---|---|
| 255664 | 7/1926 | United Kingdom | 339/5 S |

*Primary Examiner*—Roy Lake
*Assistant Examiner*—DeWalden W. Jones
*Attorney, Agent, or Firm*—Jon Carl Gealow; Ronald J. LaPorte; Bruce R. Mansfield

[57] ABSTRACT

A hollow rotatable shaft supported by bearing means surrounds a rivet extending through both ends thereof and rotatable therewith. A non-rotatable contact is connected to a terminal adjacent one end of the shaft and in brushing contact with one end of the rivet. A mechanical coupling is located at the opposite end of the shaft whereby the shaft, rivet and coupling are rotatable as a single unit and electrical current may pass through the rivet as the unit is rotating.

11 Claims, 2 Drawing Figures

ROTABLE SHAFT HAVING ELECTRICAL CONNECTION THERETHROUGH

BACKGROUND OF THE INVENTION

This invention relates broadly to electrical connectors and more specifically to an electrical connector which extends through a rotatable shaft.

In many mechanical rotating mechanisms there is required an electrical connection for supplying power to devices associated with the mechanism. Various means have been available for providing such electrical connections. One of the most common means is the use of slip rings which interconnect between the rotating mechanism and the structure upon which it is mounted. A further means for providing an electrical connection is to use wires exterior of the rotating mechanism with the electrical device mounted in a manner such that the mechanism can rotate about the electrical device.

In either of the above cases considerable cost is added to the device due to such requirements.

Accordingly, it is an object of this invention to provide a through electrical connection within a rotating shaft.

Another object of this invention is to provide a through electrical connection within a rotating shaft without the use of slip rings.

Yet another object of the invention is to provide electrical connection means in line with the rotatable shaft which is supported by bearings.

These and other objects of the invention will become apparent from the following description and drawings.

BROAD SUMMARY OF THE INVENTION

Broadly speaking the present invention comprises a hollow rotatable shaft supported by bearing means. A rivet is mounted within the shaft and extends beyond both ends thereof with one end of the rivet terminating in a head. An electrical terminal is mounted adjacent to the bearing with a shunt wire extending from the terminal and terminating in a contact which mates in a brushing fashion with the head of the rivet. A spring is secured between the terminal and the contact so as to bias the contact away from the terminal and into firm brushing contact with the rivet head. At the opposite end of the rotatable shaft, a mechanical coupling is provided so as to mate with any device which may be used. This permits rotation of the rivet with the hollow shaft at the output end of the shaft. Therefore, a through electrical connection is provided without the use of slip rings.

DETAILED DESCRIPTION OF A PREFERRED EMBODIMENT OF THE INVENTION

Figure 1:
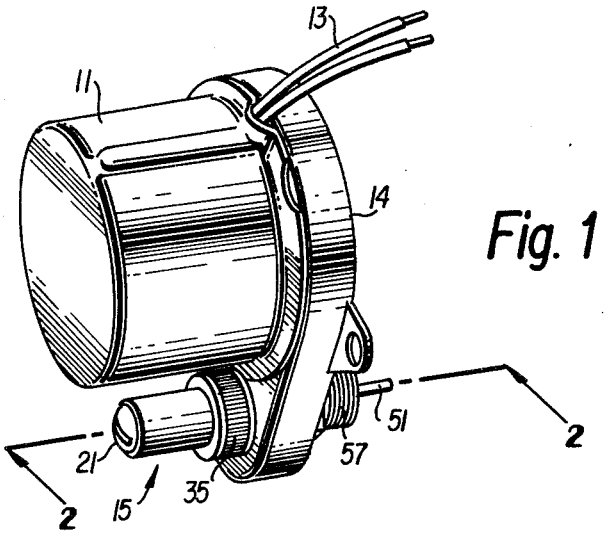
FIG. 1 is a perspective view showing the present invention used in conjunction with an electrical motor.

Turning now more specifically to the drawings, there is shown in FIG. 1 one use of the device of the present invention. A motor 11, such as a small DC motor, including electrical inputs 13 has an extended gear covering 14 which accomodates the through connection 15 of the present invention.

Figure 2:
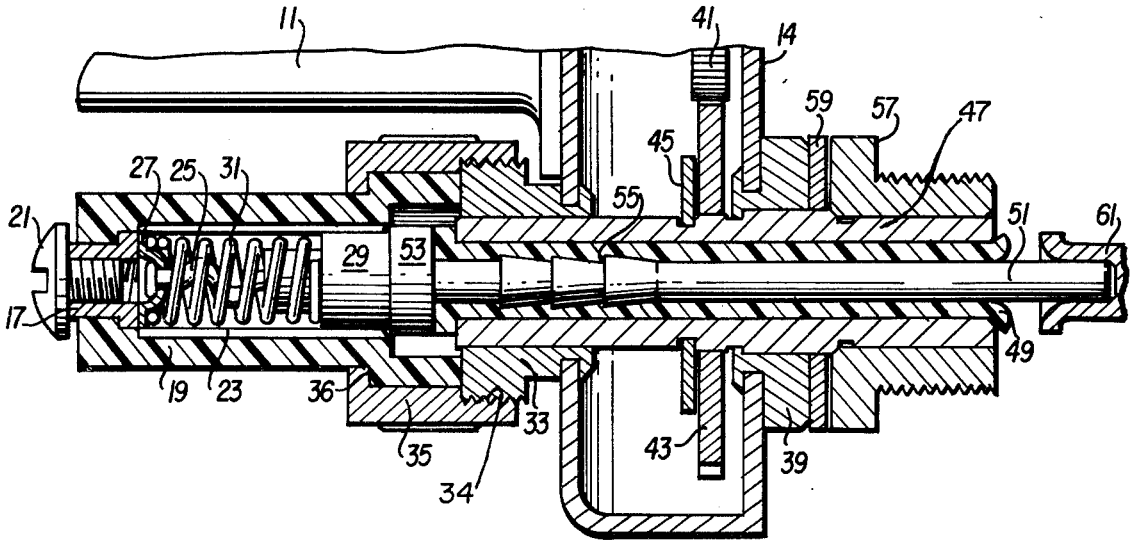
FIG. 2 is a sectional view taken along the line 2—2 of FIG. 1.

FIG. 2 is a sectional view taken through 2—2 of FIG. 1. It is to be understood that the present device may be used for any application wherein it is desirable or necessary to have a through electrical connection in cooperation with a rotatable shaft. The shaft may be driven continuously, intermittently or in an oscillatory manner, and may be driven by a motor or rotatably adjusted manually. The device is shown with the use of a small electric motor for illustrative purposes only and the invention is not to be limited thereto.

A nut 17 is secured at one end within a housing 19, with the nut having a mating screw 21. This arrangement provides the input electrical terminal to the device. Within the bore hole 23 of the housing 19, there is provided a shunt wire 25 which terminates at one end in a cap 27 which may be soldered or welded to the wire. The other end of the shunt wire terminates in a contact 29 which, for the purposes of the present usage, terminates in a flattened forward face. A coil spring 31 is placed between the cap 27 and the contact 29 and is of such a dimension that it compresses when in the position shown, thus biasing the contact 29 in a direction opposite the cap 27. It should be noted that the shunt wire 25 is of a length and is flexible so that there is freedom of movement of the cap to any distance required to function properly.

A rear bearing 33 is secured to one wall of the housing 14 and extends outwardly therefrom, terminating in a threaded flange 34. A serrated retaining collar 35 has an internally threaded section which mates with the threaded flange 34 of the bearing 33. The opposite end of the serrated retaining collar 35 abuts against shoulder 36 of the housing 19 so as to secure the housing tightly against the bearing structure. The device could be constructed so as to provide a bearing which, in itself, would retain the housing 19 firmly in the position shown.

The housing 14 contains a front bearing 39 mounted in the forward wall. In the embodiment shown, a drive gear 41 from motor 11 is shown as coupled to a driven gear 43 which is secured to hollow drive shaft 47 in a normal fashion and includes an end thrust ring 45.

Within the hollow drive shaft 47 there is secured an insulating sleeve 49 having a rivet 51 passing therethrough. The rivet extends outwardly from both ends of the drive shaft 47. The rivet 51 terminates at one end in a rivet head 53 which has a substantially flat face so as to engage in a brushing fashion with the face of contact 29. The rivet also has shoulders 55 so that it will be secured in position after it is driven into and through the sleeve 49. A mechanical coupling 57 is keyed to the hollow drive shaft 47 and includes a thrust washer 59. This coupling is provided for attachment of the mechanism to be rotated. When the mechanism is attached to the coupling 57, the electrical device to be used therewith is connected to the end of the rivet by means such as clamp 61.

As can be seen, rotation of the driven gear 43 causes a rotation of the hollow drive shaft 47, the insulating sleeve 49, and the rivet 51. With the firm brushing contact between contact 29 and the head of rivet 53, a positive electrical connection is provided through the entire rotating structure to the output lead clamp 61. In place of the output lead clamp 61, a terminal may be secured to the end of the rivet 51, or a solder connection may be made directly to the end of rivet 51.

This device is useful in any system wherein a mechanism is to be rotated and at the same time supplied with electrical power. Examples of such usage are the rotating exterior lights of ambulances, fire trucks, and police cars. It is quite obvious that the use of this invention eliminates the need for slip rings, commutating brushes or exterior wires, and the need for unusual mounting techniques of the electrical device within the rotating mechanism.

The above description and drawings are illustrative only since individual components could be replaced with equivalent structure without departing from the invention. Accordingly, the invention is to be limited only by the scope of the following claims.

I claim:

1. Electrical apparatus comprising:

a rotatable shaft having a bore extending axially therethrough;

bearing means supporting said shaft;

electrically conducting means extending through said bore and including contact means at one end thereof;

an electrical terminal spaced from said contact means;

non-rotatable shunt means connected to said terminal at one end and in brushing contact with said contact means at the opposite end; and mechanical coupling means at the end of said shaft opposite said contact means;

whereby electrical current may pass through said shaft is rotated.

2. The apparatus of claim 1 wherein said shunt means comprises:

a flexible shunt wire connected at one end to said terminal;

a contact connected at the other end of said shunt wire; and a spring secured between said terminal and said contact for biasing said contact against said contact means.

3. The apparatus of claim 1 further comprising insulating means between said hollow shaft and said conducting means.

4. The apparatus of claim 1 further comprising means for rotating said shaft.

5. The apparatus of claim 1 wherein said shunt means comprises a contact in brushing contact with said contact means and said bearing means accurately aligns and retains said contact in contact with said contact means.

6. The apparatus of claim 2 wherein said electrically conducting means comprises a rivet including a head at one end thereof extending through said bore in said shaft and rotatable therewith, said shunt means being in brushing contact with said head of said rivet.

7. The apparatus of claim 6 wherein said shunt wire, contact, rotatable shaft, rivet, electrical terminal and mechanical coupling are substantially in axial alignment with respect to the rotational axis of said shaft.

8. Electrical apparatus comprising:

an electrical terminal;

a shunt wire connected at one end thereof to said terminal;

a contact connected at the other end of said shunt wire;

spring means adjacent said shunt wire for biasing said contact away from said terminal;

a rotatable hollow shaft;

a metal rivet secured within said hollow shaft and extending therethrough;

a head formed at one end of said rivet, said head being in brushing electrical connection with said contact; and means at the end of said rotatable shaft opposite said rivet head for providing a mechanical coupling;

whereby rotation of said hollow shaft provides rotation of said rivet and said last named means and electrical current may pass through said shaft.

9. The apparatus of claim 8 further comprising bearing means for supporting said hollow shaft.

10. The apparatus of claim 8 wherein said shunt wire is flexible so as to provide for movement of said contact.

11. The apparatus of claim 8 further comprising bearing means for supporting said hollow shaft and for accurately aligning and retaining said contact in contact with said rivet head.

* * * * *